US009476234B2

(12) United States Patent
Louie et al.

(10) Patent No.: US 9,476,234 B2
(45) **Date of Patent: *Oct. 25, 2016**

(54) LOW PROFILE LATCH AND CLOSING PANEL FOR PET DOOR

(71) Applicant: Anlin Industries, Clovis, CA (US)

(72) Inventors: Jerry Lew Louie, Clovis, CA (US); Eric L. Vidmar, Clovis, CA (US)

(73) Assignee: Anlin Industries, Clovis, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/526,384

(22) Filed: Oct. 28, 2014

(65) Prior Publication Data

US 2015/0048628 A1 Feb. 19, 2015

Related U.S. Application Data

(62) Division of application No. 13/838,760, filed on Mar. 15, 2013, now Pat. No. 8,997,400.

(51) Int. Cl.

| | |
|---|---|
| ***E06B 7/32*** | (2006.01) |
| ***E06B 3/46*** | (2006.01) |
| ***E05C 19/02*** | (2006.01) |
| ***E05C 1/04*** | (2006.01) |
| ***E05D 15/16*** | (2006.01) |
| ***E05C 1/08*** | (2006.01) |
| *E05C 1/00* | (2006.01) |

(52) U.S. Cl.

CPC ..... *E05C 19/028* (2013.01); *E05C 1/04* (2013.01); *E05C 1/08* (2013.01); *E05D 15/165* (2013.01); *E06B 7/32* (2013.01); *E05C 2001/008* (2013.01); *E06B 3/46* (2013.01); *Y10T 292/097* (2015.04)

(58) Field of Classification Search

CPC ..... E06B 7/32; E06B 3/46; E05C 1/04; E05C 2001/008; E05C 1/08; E05C 1/02

USPC ..... 49/169, 170; 292/137, 138, 155, 251, 292/DIG. 11, DIG. 63

See application file for complete search history.

(56) References Cited

U.S. PATENT DOCUMENTS 371,354 A * 10/1887 Pierce ..... E05C 1/04 292/149

818,885 A 4/1906 Hake (Continued)

FOREIGN PATENT DOCUMENTS

| | | |
|---|---|---|
| EP | 2484856 A2 | 8/2012 |
| GB | 2351754 A | 1/2001 |

(Continued)

OTHER PUBLICATIONS

Radio Systems Corporation, Freedom Patio Panels Pet Door manual, available online at http://www.petsafe.net.

(Continued)

*Primary Examiner* — Justin Rephann

(74) *Attorney, Agent, or Firm* — Mark D. Miller; William K. Nelson

(57) ABSTRACT

The present invention provides improved pet doors, systems and related methods that may be used or installed on the fixed panel of a new or existing sliding door, such as a patio door, without interfering with the sliding movement of the companion door by providing a low profile closing panel and latch.

21 Claims, 5 Drawing Sheets

EXPLODED VIEW

(56) References Cited

U.S. PATENT DOCUMENTS

| | | | | |
|---|---|---|---|---|
| 1,005,636 | A | 10/1911 | Frey | |
| 1,485,301 | A * | 2/1924 | Sebastian | E05C 1/04 292/153 |
| 1,496,822 | A * | 6/1924 | Moore | E05D 15/00 16/267 |
| 1,517,447 | A * | 12/1924 | Merz | E05D 15/00 292/145 |
| 1,794,643 | A * | 3/1931 | Charles | E05D 13/06 16/443 |
| 2,888,071 | A | 5/1959 | Therien | |
| 2,974,987 | A * | 3/1961 | O'Brien | E05B 67/38 292/148 |
| 3,184,803 | A | 5/1965 | Peel | |
| 3,626,507 | A | 12/1971 | Hawkins | |
| 3,878,645 | A | 4/1975 | Porter | |
| 3,978,616 | A | 9/1976 | Pennock | |
| 3,989,291 | A * | 11/1976 | Hucknall | E05C 17/20 292/262 |
| 4,047,331 | A | 9/1977 | Davlantes | |
| 4,216,743 | A | 8/1980 | Cohen | |
| 4,226,452 | A * | 10/1980 | Hoffman | A47D 7/02 292/175 |
| 4,234,220 | A * | 11/1980 | Finch | E05B 67/383 292/148 |
| 4,334,573 | A | 6/1982 | Hackman et al. | |
| 4,421,058 | A | 12/1983 | Paul | |
| 4,603,724 | A | 8/1986 | Borwick | |
| 4,673,202 | A * | 6/1987 | Willis | E05B 13/04 292/150 |
| 4,746,152 | A * | 5/1988 | Willcox | E05B 63/128 292/150 |
| 4,754,797 | A | 7/1988 | Sronce | |
| 4,760,872 | A | 8/1988 | Hale, Jr. | |
| 4,776,133 | A | 10/1988 | Green | |
| 4,993,757 | A * | 2/1991 | Corzine | E05B 47/0002 292/144 |
| 5,161,328 | A | 11/1992 | Traue | |
| 5,177,900 | A | 1/1993 | Solowiej | |
| 5,406,748 | A | 4/1995 | Davlantes | |
| 5,535,804 | A | 7/1996 | Guest | |
| 5,588,318 | A * | 12/1996 | Osborne | E05B 47/0002 292/144 |
| 5,701,813 | A | 12/1997 | Smith | |
| 5,836,625 | A * | 11/1998 | Kibble | E05B 15/0053 292/145 |
| 5,931,032 | A * | 8/1999 | Gregory | B82Y 10/00 292/148 |
| 5,992,096 | A | 11/1999 | De La Cerda et al. | |
| 6,378,769 | B1 | 4/2002 | Wolgamot | |
| 6,385,909 | B1 | 5/2002 | Marsh et al. | |
| 6,477,872 | B1 * | 11/2002 | Denton, Jr. | E05B 67/36 70/100 |
| 6,725,806 | B1 | 4/2004 | Gribble | |
| 6,959,511 | B2 | 11/2005 | Johnson et al. | |
| 6,966,147 | B2 | 11/2005 | Solowiej | |
| 7,044,509 | B2 | 5/2006 | Radel | |
| 7,143,473 | B2 * | 12/2006 | Matsuki | E05C 17/206 16/82 |
| 7,150,244 | B2 | 12/2006 | Dawes | |
| 7,284,502 | B1 | 10/2007 | Dotter | |
| 7,814,956 | B2 | 10/2010 | Lethers et al. | |
| 7,886,486 | B2 | 2/2011 | Lomax et al. | |
| 8,136,302 | B2 | 3/2012 | Trujillo | |
| 8,595,976 | B1 | 12/2013 | Solowiej | |
| 2004/0163316 | A1 * | 8/2004 | Johnson | E06B 7/32 49/169 |
| 2005/0252622 | A1 | 11/2005 | Reid | |
| 2006/0053693 | A1 | 3/2006 | Sullivan | |
| 2007/0089684 | A1 * | 4/2007 | Brooks | E05B 17/22 119/484 |
| 2009/0260294 | A1 | 10/2009 | Sullivan | |
| 2009/0315341 | A1 * | 12/2009 | Willcox | E05B 15/101 292/163 |
| 2010/0269413 | A1 | 10/2010 | Sullivan | |
| 2013/0036672 | A1 | 2/2013 | Westerfield | |
| 2013/0305609 | A1 * | 11/2013 | Graves | E05B 47/0012 49/168 |
| 2013/0305639 | A1 | 11/2013 | Guhl | |

FOREIGN PATENT DOCUMENTS

| | | | |
|---|---|---|---|
| GB | 2361022 | A | 10/2001 |
| GB | 2460677 | A | 12/2009 |
| JP | 2000130046 | A | 5/2000 |

OTHER PUBLICATIONS

Radio Systems Corporation, Freedom Patio Panel product information, available online at www.petsafe.net/products/doors/patio-door-panels/freedom-patio-panels-for-frames-up-to-96.

Security Boss Manufacturing, MaxSeal In-the-Glass Pet Door product information, available online at www.securitybossmanufacturing.com.

Security Boss Manufacturing, MaxSeal In-the-Glass Pet Door installation guidelines, available online at http://www.securitybossmanufacturing.com/images/ITG-install-guidelines.pdf.

Pride Pet Doors, Patio pet door for sliding glass doors and screens-product information, available online at www.petmountain.com/product/patio-panel-dog-doors/11442-504265/patio-pet-door-for-sliding-glass-doors-screens.html#content.

Kindl, K., Door for Animals, English Abstract of European Patent Publication EP2484856, Aug. 8, 2012, European Patent Organization, http://www.epo.org/searching/free/espacenet.html.

Meguro, M., Sliding Door for Window Flush with Floor Face, English Abstract of Japanese Patent Publication JP2000130046, May 9, 2000, European Patent Organization, http://www.epo.org/searching/free/espacenet.html.

* cited by examiner

TOP SECTION VIEW OF THE PATIO DOOR
WITH SLIDING VENT PARTIALLY OPEN

EXPLODED VIEW

ASSEMBLED VIEW

EXPLODED VIEW

LOW PROFILE SLIDE/MOUNT ASSEMBLY

LOW PROFILE LATCH AND CLOSING PANEL FOR PET DOOR

This application is a divisional application of and claims priority to U.S. patent application Ser. No. 13/838,760 filed on Mar. 15, 2013, pending, which is incorporated herein by this reference in its entirety.

BACKGROUND OF THE INVENTION

1. Field of Invention

The present invention relates to pet doors installed in new or existing multi-panel human doors, and more particularly to a newly designed low profile latch and closing panel for a pet door that allows it to be installed on a fixed panel of a sliding door without interfering with operation of the sliding door.

2. Description of the Related Art

Pet doors are often installed in new or existing multi-panel doors to allow dogs, cats, or other domestic animals to have access through the door without the need for human intervention. Pet doors are typically installed on doors leading outdoors to allow the pet to freely exit and enter a structure. For safety and security reasons, it is desirable to be able to close and latch a pet door to restrict unwanted animals or burglars from entering a structure through the pet door.

Although pet doors are frequently installed on single-panel hinged doors, in many situations it is desirable for the pet door to be installed on one panel of a sliding door, such as a sliding glass patio door. In such situations, installing the pet door on the sliding door (vent) will ordinarily not interfere with the sliding motion of the vent. However, if the pet door is installed on the fixed panel it may interfere with sliding motion of the vent, particularly if the pet door is also equipped with a latch that protrudes into the sliding plane of the vent. This is because the removable closing panel and/or the latch of the pet door are located on the inside of the fixed panel (so that they may be accessed and operated from the inside for security reasons), which conflicts with the path of the sliding vent which is also located on the inside.

There continues to be a need, therefore, for a pet door with closing panel and latch that may be installed on the fixed panel of a sliding door without interfering with the movement of the sliding vent of the door.

SUMMARY OF THE INVENTION

The present invention provides improved pet doors, systems and related methods that may be used or installed on the fixed panel of a new or existing multi-panel sliding door, such as a patio door, without interfering with the sliding movement of the companion door by providing a low profile closing panel and latch. In embodiments of the invention, a low profile frame having an open top is used to retain the flat closing panel of the pet door which may be inserted or removed through the open top, and a low profile latch is installed at an upper corner thereof to secure the closing panel to the frame. Embodiments of the pet door and latch may be installed on the fixed panel of a multi-panel sliding door system, and are clean, compact and easy to use while allowing a sliding door vent to open freely without restriction or damage.

It is therefore an object of the present invention to provide a low profile pet door with closing panel and latch that may be installed on the fixed panel of a new or existing multi-panel sliding door without interfering with the sliding motion of the sliding panel of the door.

It is also an object of the present invention to provide a low profile pet door with a closing panel and latch that may be installed on the fixed panel of a new or existing sliding door and securely latched shut without interfering with the sliding motion of the sliding panel of the door.

It is also an object of the present invention to provide a clean, neat and aesthetically pleasing yet secure pet door that may be installed on the fixed panel of a new or existing multi-panel sliding door and used without interfering with the sliding motion of the sliding panel of the door.

Additional objects of the invention will be apparent from the detailed description and the claims herein.

BRIEF DESCRIPTIONS OF THE DRAWINGS

Figure 5:
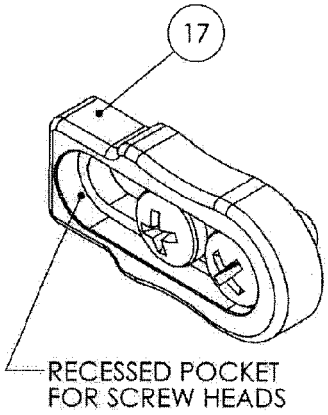
Figure 5:
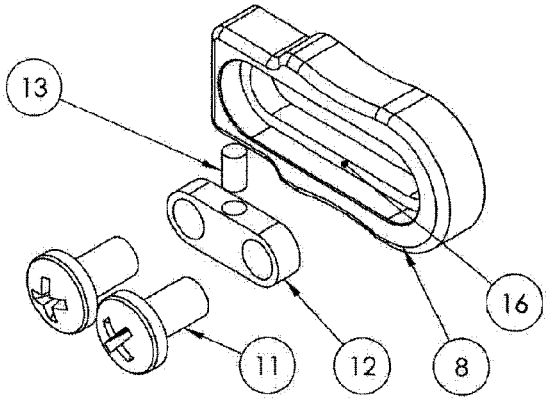
Figure 5:
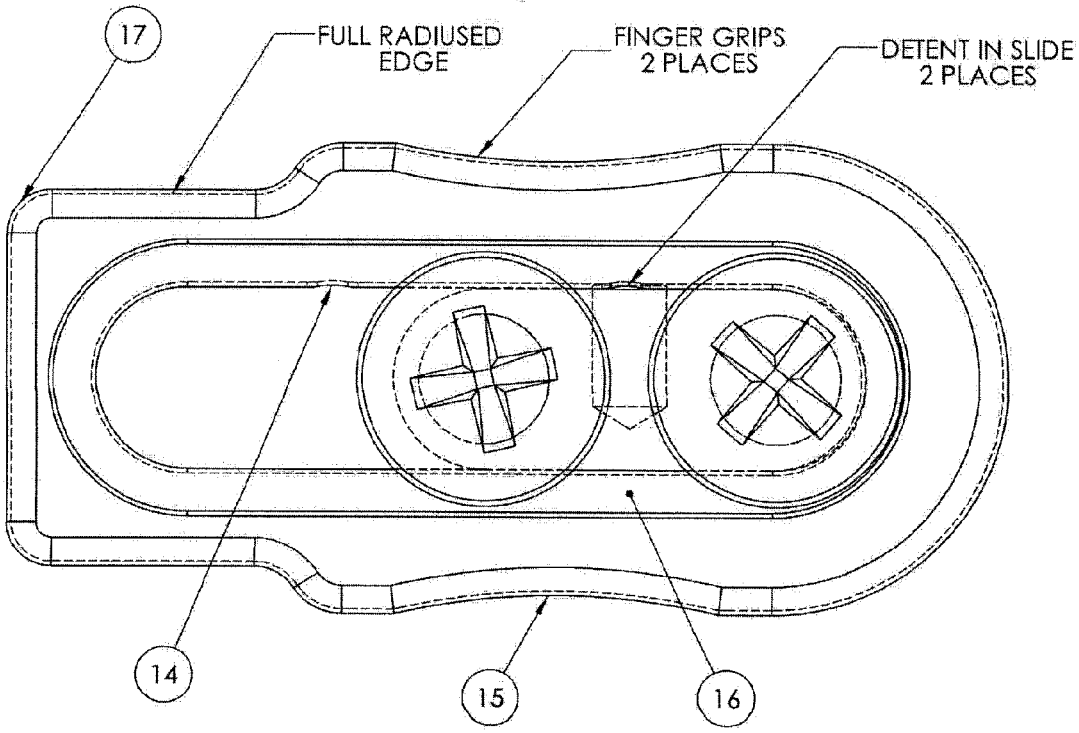

FIG. 5 includes exploded, assembled and plan views of an embodiment of a latch mechanism of the present invention.

DETAILED DESCRIPTION

Figure 1:
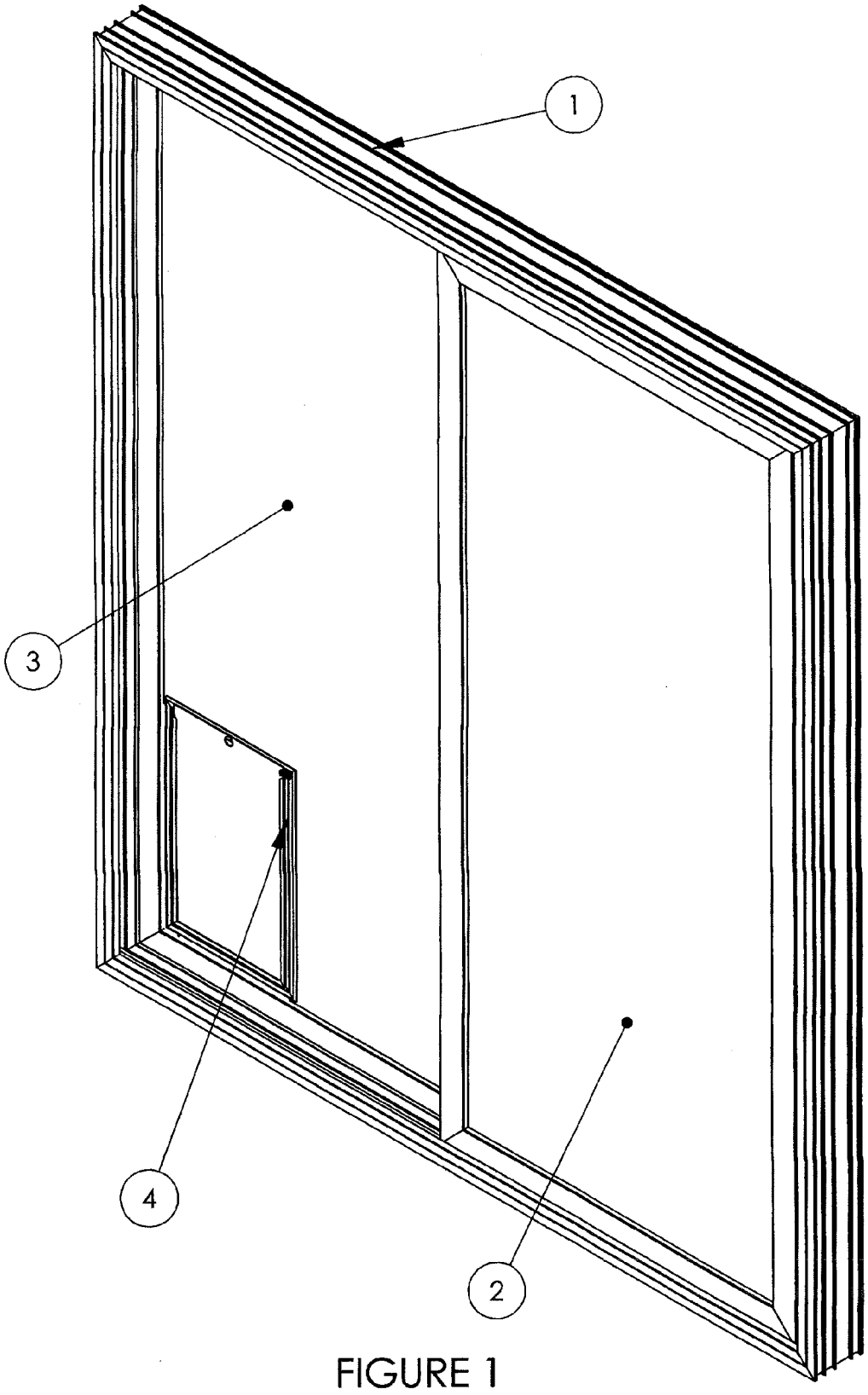
FIG. 1 is a perspective view of an embodiment of the present invention installed on the fixed panel of a multi-panel sliding patio door.

Referring to the drawings wherein like reference characters designate like or corresponding parts throughout the several views, and referring particularly to FIG. 1, it is seen that the illustrated embodiment of the present invention includes a pet door 4 and latch system that has been installed on a multi-panel sliding glass patio door assembly 1. The latch and closing panel 9 are part of the pet door 4 that is built into or otherwise installed into the fixed panel or sash 3 of the sliding door assembly. It is to be appreciated, of course, that embodiments of the pet door of the present invention may also be installed on the sliding panel (vent) 2, or on any other suitable door. In the illustrated embodiments, the low profile nature of the latch allows the sliding vent 2 to pass over the latch and panel 9 without obstruction.

Figure 2:
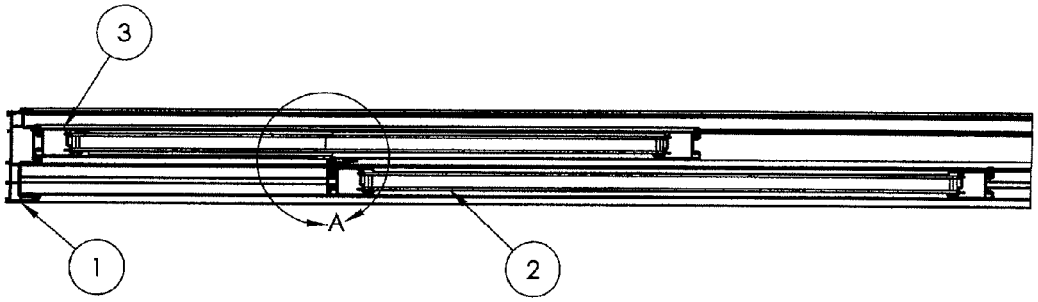
FIG. 2 is a top sectional view of an embodiment of the present invention installed on the fixed panel of a multi-panel sliding door, with a detail section A.
Figure 2:
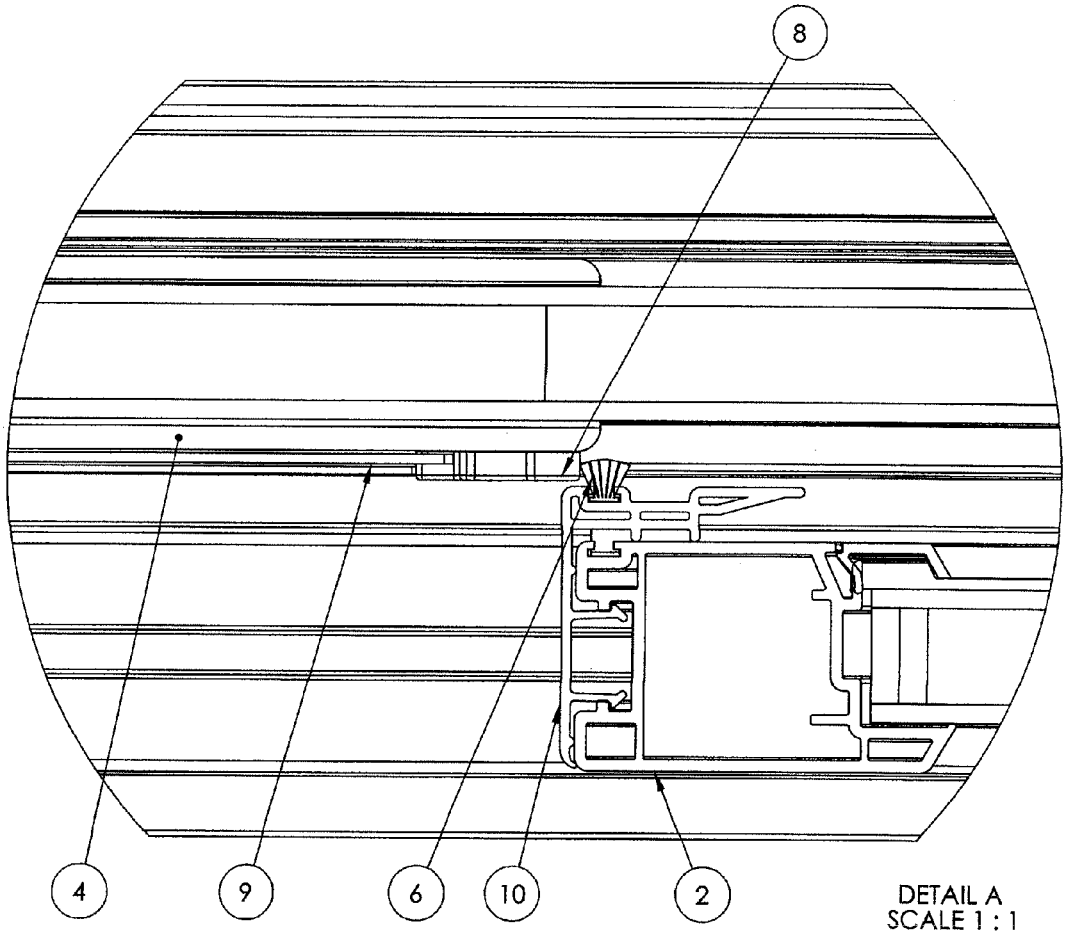

Referring to the top view of an exemplary embodiment in FIG. 2 and the detail of section A, it is seen that the sliding vent 2 includes an interlock 10 and pile weather stripping 6 which passes over the low profile finger slide 8 of the latch and notched closing panel 9. It is to be appreciated that the outside profile of the latch is defined by slide 8, and that this profile is small enough so as not to interfere with interlock 10 or any other portion of sliding vent 2 as it moves along its track, it being understood that contact with weather stripping 6 is acceptable, and often desirable.

Figure 3:
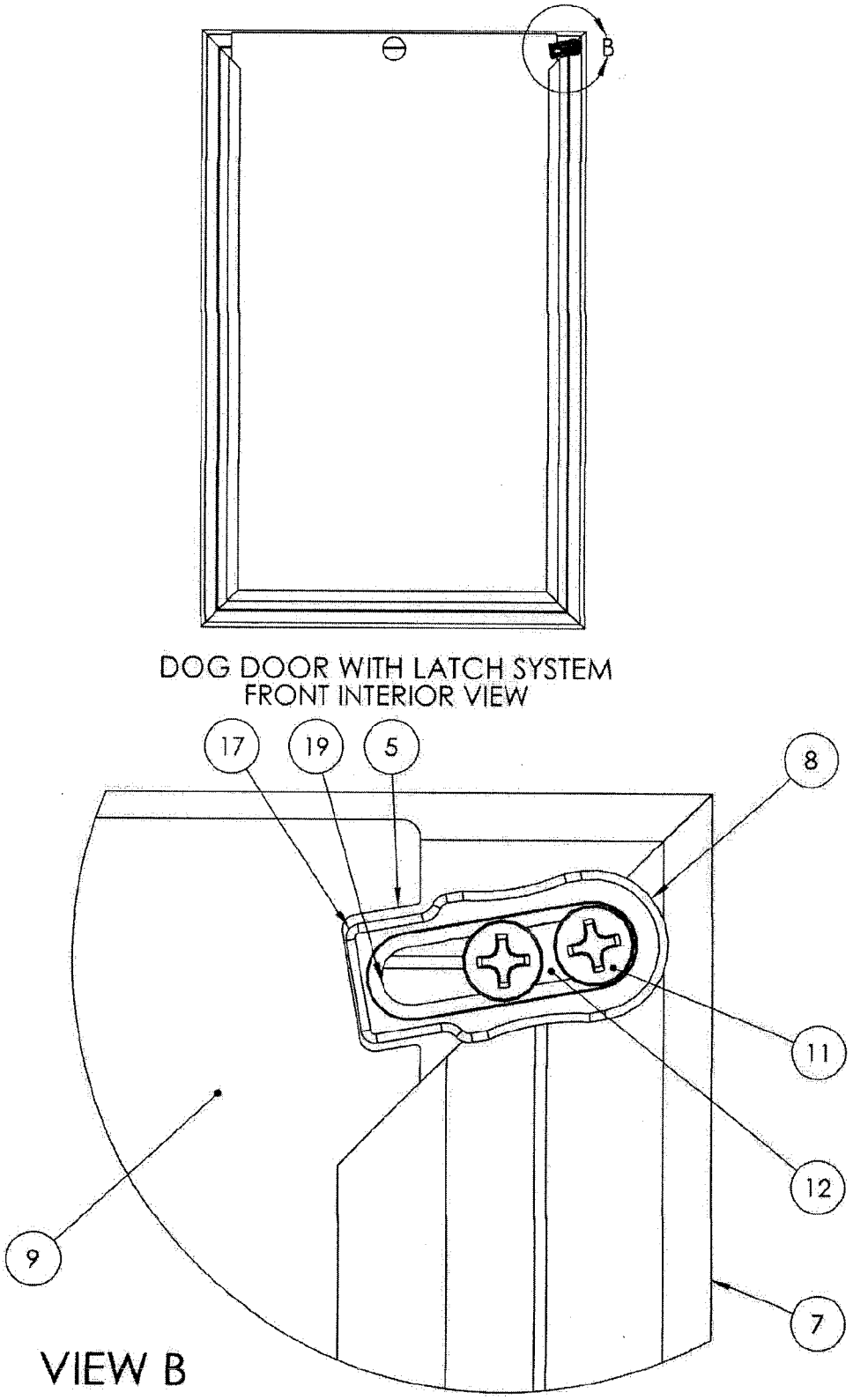
FIG. 3 is a front interior view of an embodiment of the present invention, with detail in view B.

Referring to FIG. 3, it is seen that the upper illustration shows an interior view of a typical pet door with closing panel 9 and frame 7 to which an embodiment of the unique latch of the present invention has been attached. The detailed view in the lower illustration shows parts of a latch of the present invention including a slide 8 which is capable of sliding into or out of a specially positioned notch 5 on panel 9. Slide 8 is positioned on a mount 12, using at least one but preferably two attachments 11, which are machine screws in the illustrated embodiments. Slide 8 includes an interior opening or pocket 19 having a shelf 15 which receives the mount 12 and screws 11. The heads of screws 11 should be wide enough to rest on shelf 15, and the shafts of screws 11 should be long enough to extend through mount 12, through opening 19 and into corresponding openings 18 on the pet door frame 7 for secure attachment thereto. Openings 18 may be drilled and tapped to accept the attachment mechanisms of the latch assembly. Interior pocket 19 is longer than the space needed for mount 12 allowing slide 8 to move back and forth on mount 12. This allows the nose 17 of slide 8 to be inserted into notch 5 to secure the position of closing panel 9 as shown in FIG. 3, and then to be removed from notch 5 to allow closing panel 9 to be removed from the pet door 4. Interior pocket 19 is preferably wider than mount 12, and a biasing member 13 is preferably provided with mount 12 to hold the position of slide 8 in place. This helps prevent slide 8 from being accidentally inserted into or removed from notch 5 by such things as vibrations caused by the sliding door. Biasing member 13 may be eliminated in favor of a wider mount 12 with more frictional contact with pocket 19, but this is not preferred since even small amounts of dirt or other debris could easily interfere with smooth operation of the latch.

Figure 4:
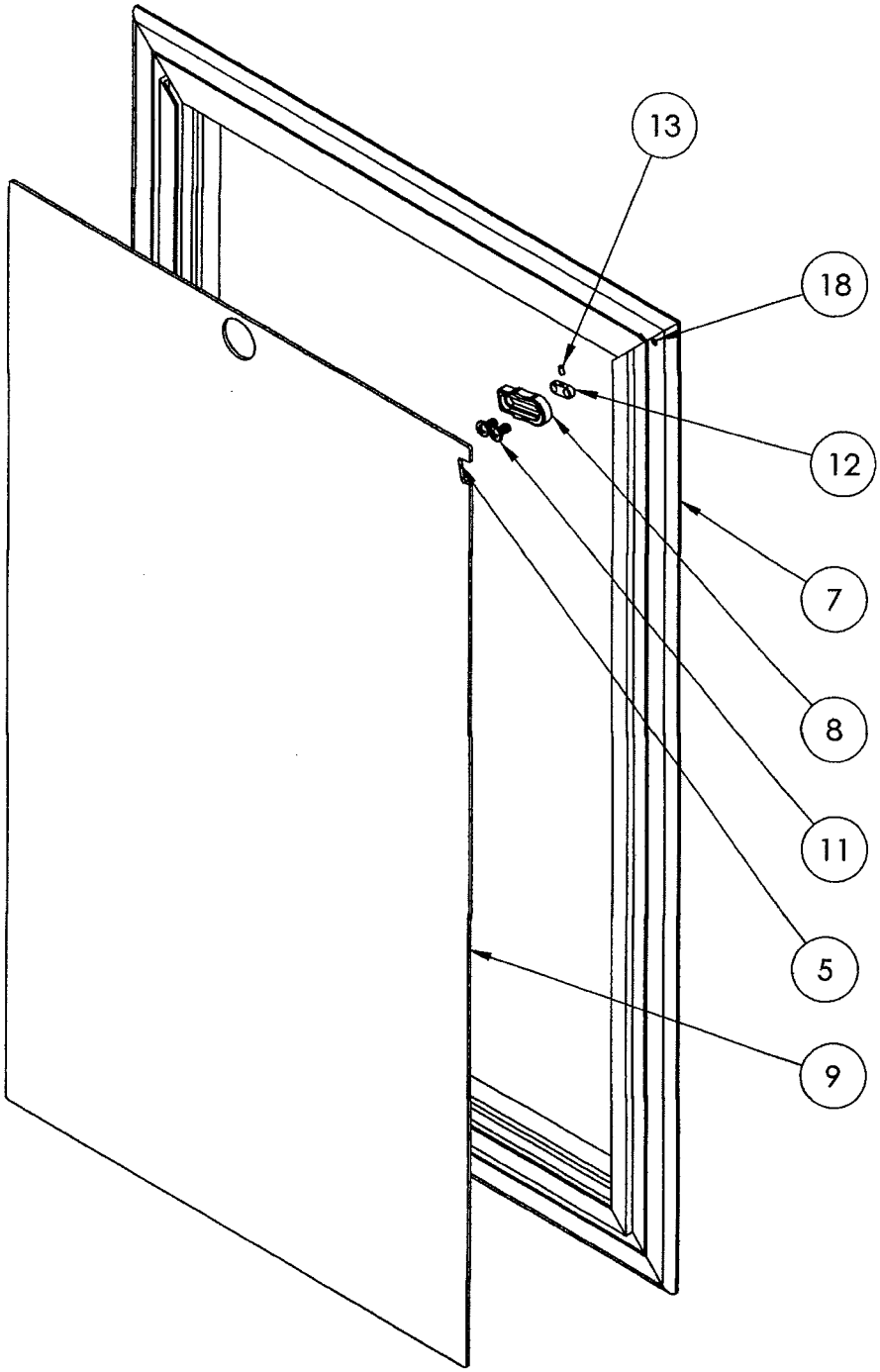
FIG. 4 is an exploded view of an embodiment of the present invention.

FIG. 4 is an exploded view of an embodiment of the invention showing illustrating a closing panel 9 with notch 5; a slide 8 with attachment bolts 11, mount 12, and a rubber cord biasing member 13; and openings 18 in frame 7 for receiving bolts 11.

Referring to the exemplary embodiment of the latch assembly of FIG. 5, it is seen that mount 12 is made of anodized aluminum, although any suitable rigid material, such as metal or plastic, may be used. In this example, a rubber cord 13 cut to a specific length is inserted onto a cross drilled hole to act as a compression spring. The latch slide 8 is thereby machined so that the slot 19 has clearance on the width so the mount 12 fits within it. With the latch slide 8 and the mount 12 preassembled, the two illustrated machine screws 11 may then be aligned through corresponding holes of the mount 12 and then screwed into openings 18 in the pet door frame 7. In this embodiment, the heads of the machine screws 11 tighten down on the shelf 15 of pocket 19 allowing mount 12 to move in pocket 19, thereby capturing slide 8 it while still allowing it to slide in pocket 19. In the exemplary embodiment, a powder coated notched aluminum closing panel 9 is inserted into the guides of an extruded aluminum pet door frame 7.

Use of embodiments of the present invention are very simple when installed in a multi-panel sliding glass patio door 1 as shown in FIG. 1. The closing panel 9 may be inserted into frame 7, and the nose 17 of latch slide 8 moved into slot 5, locking the closing panel and restricting use of the pet door. Nose 17 of latch slide 8 must be retracted out of slot 5 to remove closing panel 9. This is accomplished by pulling the finger latch slide 8 in a linear motion away from the pet door and disengaging the latch slide 8 from the notch 5 in the closing panel 9. The closing panel 9 will then be free to slide upwards in a vertical motion, using the provided finger hole. The closing panel 9 may then be removed from the pet door 4 allowing full use.

In embodiments of the present invention, the thickness of slide 8 should be no larger than about 13/64 inch (0.2") in order to avoid contact with door panel 2, preferably around approximately 0.18 inch (0.18"), thereby providing an extremely low profile which allows clearance between slide 8 and sliding door panel 2 as shown in FIG. 2. It is to be appreciated that slide 8 may have a lesser thickness of as little as 11/64 inch (0.17"), but any amount below this may not provide sufficient room for a biasing member 13. In embodiments of the invention, the closing panel 9 is made of material having a thickness of approximately 6/100 inch (0.06"), although a thickness of between about 4/100 inch (0.040") and about 8/100 inch (0.080") are acceptable and would still avoid contact with door panel 2.

In the illustrated embodiments, the nose 17 of slider 8 of the latch assembly is mounted onto the pet door at an angle of about 10 degrees from horizontal, or about 100 degrees from the side wall of the pet door (see FIG. 3, Detail A), although any angle between 5 degrees and 15 degrees from horizontal (95 degrees to 115 degrees from the side wall) would be suitable. The optimum angle of 10 degrees from horizontal allows for a more positive latch slide 8 to closing panel 9 engagement to aid in preventing the slide from retracting and the panel becoming unlatched.

In order to maintain its low profile, the heads of the two machine screws 11 act as the retainer for the latch slide 8 while staying below the front surface of the latch slide 8 being located in the recessed pocket 19, with their heads engaged against shelf 16 as shown in FIG. 5.

In the illustrated embodiment, biasing member 13 is provided in the form of a rubber cord for insertion into mount 12, as seen in FIG. 5, which sits slightly above the mount surface. When assembled with the latch slide 8, the exemplary rubber cord 13 is compressed which creates drag in the slide when it is actuated. It is to be appreciated that biasing member 13 may be made of any other suitable damping material such as without limitation a ball and compression spring, or any slightly deformable material that will retain its compressibility over time and use.

In some embodiments of the invention, two optional detents 14 may be provided on the upper inside edge of the latch slide 8 slot 19. These detents are located so that when the latch slide 8 is fully extended (locked position) or fully retracted (open position), biasing member 13 will slightly uncompress allowing the user to feel a positive action when moving it into the open or closed positions. In embodiments of the invention, optional finger grips 15 may be provided on one or both sides of the latch slide 8 to provide a positive feel when extending or retracting the slide, reducing slippage, as shown in FIG. 5. In some embodiments, the edge or perimeter of slide mount 8 may be rounded or fully radiused as shown in FIG. 5, which not only allows for a soft edge for the fingers to grip, but also allows for the pile weather stripping 6 to pass smoothly over when the sliding vent is opened and closed, as shown in FIG. 2.

It is to be understood that variations and modifications of the present invention may be made without departing from the scope thereof. It is to be appreciated that the features disclosed herein may be used different combinations and permutations with each other, all falling within the scope of the present invention. It is also to be understood that the present invention is not to be limited by the specific embodiments disclosed herein, but only in accordance with the appended claims when read in light of the foregoing specification.

What is claimed is:

1. A low profile latch assembly for a pet door assembly having a swinging pet door and a removable locking panel for blocking passage through said swinging pet door, said low-profile latch assembly comprising an elongated movable member having a thickness of between about 11/64 inch and about 13/64 inch and a central bore therein for receiving a mount for movably holding said movable member against a frame of said pet door assembly such that said movable member is capable of sliding movement relative to said mount for insertion of said movable member into a notch in an edge of said removable locking panel when said removable locking panel is positioned in said frame, wherein said low profile latch assembly is operable to be positioned between a fixed position panel and a sliding panel of a sliding door assembly and said sliding panel can slide past the low profile latch assembly without obstruction by the low profile latch assembly when said pet door assembly is mounted in said fixed position panel, and said movable member is moveable along a plane that is substantially parallel to planes in which said fixed position panel and said sliding panel are mounted.

2. The latch assembly of claim 1 further comprising a biasing member between said movable member and said mount for holding said movable member in place.

3. The latch assembly of claim 2 further comprising at least one detent in said central bore for engaging said biasing member.

4. The latch assembly of claim 1 wherein said notch has an angle of about 100 degrees relative to a side wall of said removable locking panel, and said movable member being positioned at an angle that is complementary to the angle of said notch.

5. The latch assembly of claim 1 wherein the thickness of said movable member is about 0.2 inch.

6. The latch assembly of claim 1 wherein the thickness of said movable member is about 0.19 inch.

7. The latch assembly of claim 1 further comprising a biasing member in a recess in said mount for engaging said elongated movable member.

8. The latch assembly of claim 7 further comprising a detent in said elongated movable member at an edge of said central bore for engaging said biasing member.

9. The latch assembly of claim 8 wherein said elongated movable member includes a nose for insertion into said notch.

10. The latch assembly of claim 9 wherein said detent is positioned away from said nose such that said biasing member engages said detent when said nose is inserted into said notch to thereby secure said removable locking panel in said frame.

11. The pet door and latch assembly of claim 7 further comprising a first detent for holding said latch assembly in a closed position and a second detent for holding said latch assembly in an open position, said first and second detents being positioned in said elongated movable member at an inner edge of said central bore for engaging said biasing member, wherein said first detent positioned away from a nose of said elongated movable member for insertion into said notch, said biasing member being operable to engage said first detent when said nose is inserted into said notch, thereby securing said removable locking panel in said frame, and said second detent positioned near said nose such that said biasing member engages said second detent when said nose is removed from said notch.

12. The pet door and latch assembly of claim 7 wherein said biasing member includes a rubber spring positioned in said recess in said mount.

13. The pet door and latch assembly of claim 1 wherein said elongated movable member comprises at least one grip groove along an outer edge of said elongated movable member.

14. The pet door and latch assembly of claim 1 wherein said removable locking panel has a thickness of no more than 0.08 inches.

15. The latch assembly of claim 1, wherein said frame has a slot operable to be positioned on an interior side of said fixed position panel, said frame is operable to be mounted in said fixed position panel, and the removable locking panel is operable to be inserted into said slot.

16. A low profile latch assembly for a pet door comprising:

an elongated slidable piece having a central opening therein for receiving at least one mount for holding said elongated slidable piece in alignment with an angular notch in a pet door panel while allowing said elongated slidable piece to slide relative to said mount, a nose at an end of said elongated slidable piece for insertion into said notch, wherein said latch assembly is for mounting on a pet door frame in a multi-panel sliding glass door and said elongated slidable piece has a thickness that is sufficiently small to allow a sliding panel of said multi-panel sliding door to pass over said elongated slidable piece; and a biasing member between said elongated slidable piece and said at least one mount for holding said elongated slidable piece in place; and a first detent for holding said latch assembly in a closed position and a second detent for holding said latch assembly in an open position, said first and second detents being positioned in said elongated slidable piece at an inner edge of said central opening for engaging said biasing member, wherein said first detent is positioned away from said nose such that said biasing member engages said first detent when said nose is being inserted into said notch, thereby securing said pet door panel in a slot in said pet door frame, and said second detent is positioned near said nose such that said biasing member engages said second detent when said nose is removed from said notch.

17. A low profile latch assembly for a pet door assembly having a swinging pet door and a removable locking panel for blocking passage through said pet door, said pet door assembly being operable to be installed in a fixed position panel of a multi-panel sliding door unit, said low profile latch assembly comprising:

an elongated slidable piece having a central opening therein for receiving at least one mount for holding said slidable piece and allowing said slidable piece to slide relative to said at least one mount, wherein said slidable piece is in alignment with a notch in a perimeter of said removable locking panel when said removable locking panel is inserted into said pet door assembly;

a nose at an end of said slidable piece for insertion into said notch, wherein said latch assembly is operable to be positioned between said fixed position panel and a sliding panel of said sliding door unit and said slidable piece has a thickness that is sufficiently small to allow said sliding panel to pass over said low profile latch assembly without obstruction by the low profile latch assembly.

18. The low profile latch assembly of claim 17, further comprising a biasing member between said elongated slidable piece and said at least one mount for holding said elongated slidable piece in place.

19. The low profile latch assembly of claim 17, wherein the thickness of said slidable piece is not more than about 0.20 inches.

20. The low profile latch assembly of claim 17, wherein said slidable piece is moveable along a plane that is substantially parallel to the planes of said fixed position panel and said sliding panel.

21. The low profile latch assembly of claim 17, further comprising a frame for mounting said pet door assembly in the fixed position panel of said multi-panel sliding door unit, said frame having a slot on the interior side of said fixed position panel, wherein said removable locking panel is operable to be inserted into said slot to prevent passage through said pet door assembly.

* * * * *